US006439295B1

(12) United States Patent
Hoellrigl et al.

(10) Patent No.: US 6,439,295 B1
(45) **Date of Patent: *Aug. 27, 2002**

(54) PROCESS FOR MANUFACTURING A STRIP OF ALUMINUM ALLOY FOR LITHOGRAPHIC PRINTING PLATES

(75) Inventors: Guenther Hoellrigl, Schaffhausen (CH); Glenn Smith, Wolverhampton (GB)

(73) Assignee: Alcan Technology & Management Ltd. (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/896,539

(22) Filed: Jul. 18, 1997

(30) Foreign Application Priority Data

Jul. 25, 1996 (EP) ..... 96810492

(51) Int. Cl.[7] ..... B22D 11/12; B21B 1/46

(52) U.S. Cl. ..... 164/476; 148/551; 148/552; 148/693; 148/697; 148/437; 29/527.7

(58) Field of Search ..... 164/476; 148/551, 148/552, 693, 697, 437; 29/527.7

(56) References Cited

U.S. PATENT DOCUMENTS

| | | | | |
|---|---|---|---|---|
| 4,715,903 A | | 12/1987 | Asten et al. | |
| 4,800,950 A | * | 1/1989 | Crona et al. | 164/476 X |
| 5,456,772 A | * | 10/1995 | Matsuki et al. | 148/551 |
| 5,503,689 A | * | 4/1996 | Ward et al. | 148/551 X |
| 5,525,168 A | | 6/1996 | Sawada et al. | 148/416 |
| 5,562,784 A | | 10/1996 | Nishikawa et al. | 148/549 |
| 5,655,593 A | * | 8/1997 | Wyatt-Mair et al. | 164/476 |
| 5,711,827 A | * | 1/1998 | Sawada et al. | 148/552 |

FOREIGN PATENT DOCUMENTS

| | | |
|---|---|---|
| EP | 0 193 710 | 9/1986 |
| EP | 0 640 694 | 3/1995 |
| EP | 0 643 149 | 3/1995 |
| EP | 0 657 559 | 6/1995 |
| EP | 0 672 759 | 9/1995 |

OTHER PUBLICATIONS

Patent Abstracts of Japan, vol. 013, No. 423 (C–638) (Sep. 20, 1989) and Kuniaki et al.—Japanese Published Pat. Appl. No. 01–162751 Published Jun. 27, 1989.

* cited by examiner

*Primary Examiner*—Tom Dunn
*Assistant Examiner*—I.-H. Lin
(74) *Attorney, Agent, or Firm*—Fisher, Christen & Sabol

(57) ABSTRACT

A process for manufacturing a strip of aluminium or an aluminium alloy for electrolytically roughened lithographic printing plates, in which the alloy is continuously cast as a strip and then rolled to final thickness, is such that the cast strip is rolled to final thickness with a thickness reduction of at least 90% without any further heating. The resultant microstructure in the region close to the surface of the strip leads to improved electrolytic etching behaviour.

6 Claims, 2 Drawing Sheets

380 C/dm²

10 µm

450 C/dm²
10 μm

410 C/dm²
10 μm

380 C/dm2

10 μm

PROCESS FOR MANUFACTURING A STRIP OF ALUMINUM ALLOY FOR LITHOGRAPHIC PRINTING PLATES

BACKGROUND OF THE INVENTION

1. Field of the Invention

The invention relates to a process for manufacturing a strip of aluminum or an aluminum alloy for electrolytically roughened lithographic printing plates, whereby the alloy is continuously cast as a strip and the cast strip is then rolled to final thickness.

2. Background Art

Lithographic printing plates made of aluminum, typically having a thickness of about 0.3 mm, exhibit advantages over plates made of other materials, only some of which are:

- A more uniform surface, which is well suited for mechanical, chemical, and electrochemical roughening;
- A hard surface after anodizing, which makes it possible to print a large number of copies;
- Light weight;
- Low manufacturing costs.

The publication "Aluminium Alloys as Substrates for Lithographic Plates," by F. Wehner and R. J. Dean, 8th International Light Metals Conference, Leoben-Vienna, 1987, provides a summary of the manufacture and properties of the strip for lithographic printing plates.

Today, lithographic printing plates are made mainly from aluminum strip which is produced from continuously cast slabs by hot and cold rolling, whereby said process includes intermediate annealing. In recent years various attempts have been made to process strip-cast aluminum alloys into lithographic plates, whereby in the process of rolling the cast strip to its final thickness at least one intermediate anneal has been necessary.

The microstructure close to the surface of strip after it has been rolled to final thickness is decisive for achieving uniform roughening via electrolytic roughening and electrochemical etching.

Up to now it has not been possible to obtain an etched structure in lithographic plate starting from cast strip which is superior to that obtained from conventionally continuously cast ingot.

BROAD DESCRIPTION OF THE INVENTION

The object of the present invention is therefore to provide a process of the kind mentioned at the start, in which the strip, rolled to final thickness, exhibits an optimum microstructure for electrochemical etching.

That objective is achieved by way of the invention in that the rolling to final thickness is performed with a thickness reduction of at least 90 percent and without any further heating.

Here, "without any heating" means that the cast strip, after leaving the gap between the casting rolls, is not supplied with any heat from outside the strip until the rolling to final thickness has been completed. If the cast strip, which exhibits a relatively high temperature for a certain time after emerging from the gap between the casting rolls, is to be rolled to final thickness a short time after casting, then the starting temperature for rolling may be increased, especially in the case of large strip thickness. In the cast of small strip thickness, the processing represents rolling to final thickness by cold rolling, without intermediate annealing.

The thickness of the cast strip is preferably at most 5 mm, in particular at most 4 mm. An ideal microstructure is obtained if the thickness of the cast strip is at most 3 mm, in particular 2.5 to 2.8 mm.

In principle any strip casting method may be employed to produce the cast strip. Ideally, however, rapid solidification and, simultaneously, hot forming in the roll gap are desired. Both of the last mentioned properties are provided, e.g., by the roll casting method in which the alloy is cast in strip form between cooled rolls. In the further processing of the cast strip by cold rolling, the advantageous grain structure in the regions close to the surface resulting from rapid solidification is retained.

The continuous casting process enables high solidification rates to be obtained and, at the same time, very fine grain sizes in the regions close to the surface as a result of dynamic recovery immediately after the cast strip leaves the roll gap.

The further processing of the cast strip involves coiling the cast strip to a coil of the desired size. In the subsequent processing step the strip is cold rolled to a final thickness of 150–300 $\mu$m in a cold rolling mill suitable for producing lithographic sheet.

The strip which has been solidified and partially hot formed in the roll gap is not subjected to any further heating—this in order to prevent grain coarsening from occurring. If the thickness of the cast strip is, however, much greater than 3 mm, e.g. 7 mm, then it may be necessary for the cast strip to be subjected to a hot rolling pass immediately after leaving the roll gap before it is rolled to final thickness. To achieve an optimum grain structure, at the same time minimising costly processing steps, one should if possible cast to such a small thickness that a hot rolling pass can be dispensed with.

Cold rolling without intermediate annealing leads to a highly cold-formed structure with a high density of dislocations and hence to a preferred microstructure which guarantees uniform electrochemical attack on etching.

Apart from the advantage of uniform attack on etching, the strip manufactured according to the invention also exhibits excellent mechanical properties e.g. high strength which diminishes only insignificantly during the stoving of a photosensitive coating in the production of litho-graphic printing plates.

The strip manufactured according to the invention is equally suitable for etching in HCl and $HNO_3$ electrolytes, whereby the advantages of the microstructure obtained are realised especially on etching in an $HNO_3$ electrolyte.

In principle all of the aluminium alloys normally employed for making lithographic printing plates may be employed for producing strip according to the invention. Especially preferred for this purpose are alloys of the type AA 1xxx, AA 3xxx or AA 8xxx.

After electrolytic etching in an $HNO_3$ electrolyte, lithographic printing plates made from the strip produced according to the invention exhibit an improved etched structure for the same energy consumption compared to that of conventionally produced printing plates.

The advantage of a lithographic printing plate made according to the invention over a conventionally produced plate is also that after the stoving of a photosensitive coating e.g. for 10 min at 250° C., the printing plate made according to the invention exhibits higher strength.

The above mentioned advantageous microstructure in the region close to the surface of the strip arises essentially because of the rapid solidification at the surface. As a result of the rapid solidification, the second phase particles in the microstructure precipitate out in a very fine form and in high density. These particles act as the first centres of attack during etching, especially if the electrochemical roughening takes place in an $HNO_3$ electrolyte. When the rate of solidification at the surface is fast, the above mentioned particles exhibit an average spacing of less than 5 $\mu$m and form therefore a continuous network of uniform points of attack at the surface. The growth of the actual three-dimensional roughness pattern starts from these first, uniform and highly numerous points of attack distributed over the whole surface of the strip. The small size of the mentioned intermetallic phases has the additional advantage that they considerably shorten the time required for electrochemical dissolution at the start of etching, as a result of which electrical energy can be saved. As non-equilibrium phases are formed by way of preference close to the surface of the strip during the rapid solidification according to the invention, the rate of dissolution of the mentioned fine particles is again higher than the rate of solution of the coarse intermetallic phases of equilibrium composition such as are formed in conventionally processed materials.

A further essential microstructural feature of the strip manufactured according to the invention is the small grain size formed during strip casting. The high density of points of penetration of the grain boundaries at the surface, together with a high density of vacancies in the grains themselves, leads to chemically active points of attack that continuously create new etching troughs.

The described microstructure at the surface of the strip leads to a significant improvement in the chemical etching process that creates the uniform roughness pattern required of lithographic printing plates. The advantages gained by using the strip produced according to the invention are as follows:

- uniformly etched structure as a result of a high density of points of attack at the surface
- etching or an $HNO_3$ electrolyte under critical electrochemical process conditions
- extending the etching parameters into the range of lower charging densities, thus saving electrical energy
- preventing etching errors in $HNO_3$ electrolytes due to undesired passivation reactions
- forming a dense network of cracks in the oxide layer in the passivation range of the anodic potential via a high density of small intermetallic particles of nonequilibrium structure
- forming a dense network of vacancies in the natural oxide skin in the passivation range of the anodic potential as a result of a small grain size with many points where the grain boundaries penetrate the oxide layer.

The advantage of a strip material produced according to the invention over strip material conventionally manufactured is seen in the following summary of test results relating to the surface condition of the strip surface which, as explained above, has a decisive influence on etching behavior. The improved etching behavior of the printing plates manufactured according to the invention over conventional printing plates is explained by way of two examples which are documented by scanning electron microscope photographs which show at a magnification of 1,000 times in

DETAILED DESCRIPTION OF THE INVENTION

Figure 1:
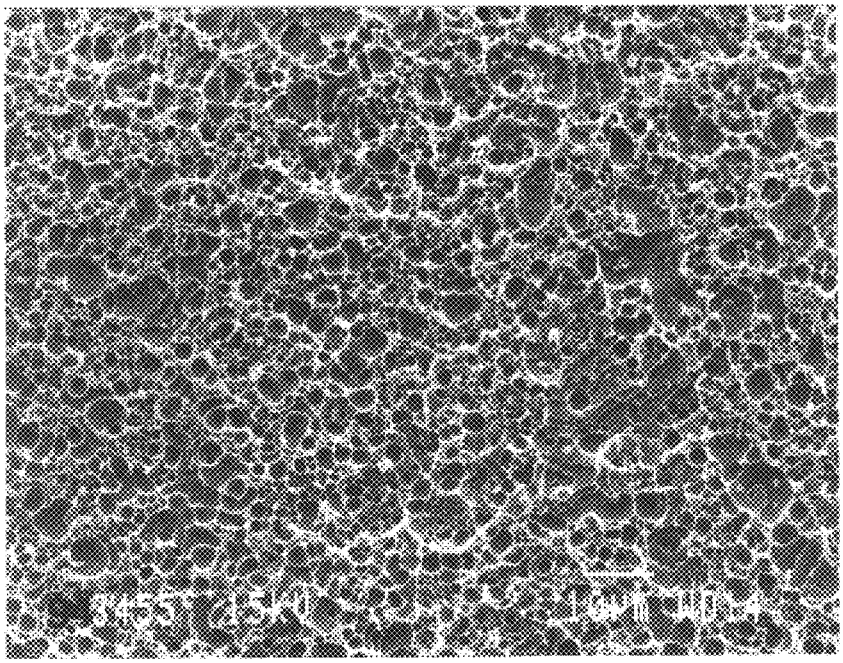
FIG. 1 (PRIOR ART)
FIGS. 1 and 2 the etch structure in conventionally manufactured printing plates, and in FIG. 3 the etch structure in a printing plate manufactured according to the invention.

The material employed for comparison purposes was the alloy AA 1050 (Al 99.5). The conventionally produced strip was cast by conventional strip casting and subjected to intermediate annealing at a thickness of 2.5 mm before being cold rolled to its final thickness of 0.3 mm.

The strip manufactured according to the invention was initially cast as a 2.5 mm thick strip between the casting rolls of a strip casting machine then, without intermediate annealing, cold rolled to its final thickness of 0.3 mm.

The density of intermetallic particles per unit surface area in the immediate surface region of the strips was determined:

Strip cast material: 6250 particles/mm$^2$

Continuously cast material: 3400 particles/mm$^2$

The same measurements made in the strip cross section close to the surface yielded the following results:

Strip cast material: 74,000 particles /mm$^2$

Continuously cast material 17,500 particles /mm$^2$

In both cases the particles are AlFeSi-containing phases, the size and distribution of which are determined by markedly different solidification rates in the regions close to the surface. The higher density per unit surface area measured in cross-section is a result of the flattening of the grains on rolling.

The second critical parameter viz, grain size, was measured at the intermediate thickness of 2.5 mm. In that respect, it must be noted that the strip cast material is actually in a slightly deformed as-cast state, whereas the conventionally continuously cast material is in a recrystallised state at this thickness after having been subjected to intermediate annealing. The two grain sizes compared here are therefore representative, as both strips are subsequently sub-jected to the same degree of reduction by rolling down to the same final thickness. The measured number of grains per unit surface area at the surface and close to the surface (cross-section) were as follows:

| | Surface | Cross-section |
|---|---|---|
| Strip cast material | 20,000 grains/mm$^2$ | 48,000 grains/mm$^2$ |
| Continuously cast material | 250 grains/mm$^2$ | 520 grains/mm$^2$ |

The fine grains in the strip cast material are mainly due to the formation of sub-grains, the average size of which is around 5 $\mu$m, whereas the recrystallised grains after the coil annealing in conventional production has an average size of about 70 $\mu$m. As mentioned above, the further processing of the conventionally continuously cast strip and the strip cast according to the invention comprises cold rolling to the desired final thickness of the lithographic sheet i.e. to a thickness of 0.2 to 0.3 mm. An essential property of the lithographic sheet is derived from the subsequent process step viz., electrochemical roughening which should provide the surface with an etched structure that is as uniform as possible. For that purpose either an electrolyte of dilute hydrochloric acid (HCl) or an electrolyte of dilute nitric acid ($HNO_3$) is employed and, depending on the type of lithograpic sheet, produces a characteristic etch structure on applying an alternating current.

If the etching is performed in a nitric acid based electrolyte, it is found in practice that a uniform etch structure is obtained only if it is possible to control certain etching parameters properly. If e.g. for economic reasons, the electrical charge (in coulomb $dm^2$) is too low, then an irregular etch pattern results—usually with streaks where no attack has taken place. If etching is carried out under these critical conditions then all the fine differences in the structure of the substrate become visible and a grading of the lithographic materials used can be observed.

The reason why the $HNO_3$ electrolyte is sensitive to the etching behaviour of the aluminium is related to its anodic passive range (passive oxide) and the related difficulty in nucleating etch pits. Only when a critical anodic potential of +1.65 V (SCE) has been reached, is this passive range overcome by forming etch pits. In the case of HCL electrolytes on the other hand pits are formed already at a corrosion potential of −0.65 V (SCE). The result of this is that in $HNO_3$ electrolytes the intermetallic phases the structure in the potential range −0.5 to −0.3 V (SCE) are dissolved first, before the aluminium matrix is attacked, and pitting takes place. The distribution of this intermetallic phase forms a first network of pits over the etched surface; the density of these particles per unit area is therefore critical.

The improved structure according to the invention is therefore apparent, as the high density of intermetallic particles at the surface provide many first points of attack in the still passive aluminium surface.

The second improvement in structure viz., the fine grain size is similar. Grain boundaries always represent weaknesses in the natural oxide skin on aluminium. The finer the grain, the more defective points there are in the surface oxide layer and the higher the rate at which etch pits will be nucleated.

The improved etching behaviour according to the invention is demonstrated in the following by way of two examples viz.,

EXAMPLE 1

Electrolyte: 20 g/l $HNO_3$ 1 g/l Al room temperature

Substrate material: AA 1050, in both cases of identical composition.

In order to produce a uniform etch structure, conventionally produced lithographic sheet required a charge of at least 480 coulomb/$dm^2$ at a constant voltage and an etching time of 60 sec starting from an initial current density of 20 A/$dm^2$.

By way of contrast, the lithographic sheet produced according to the invention required a charge of only 360 coulombs/$dm^2$ to form a uniform etch structure. The initial current density was 17 A/$dm^2$ and the etching time 55 sec.

EXAMPLE 2

Figure 2:
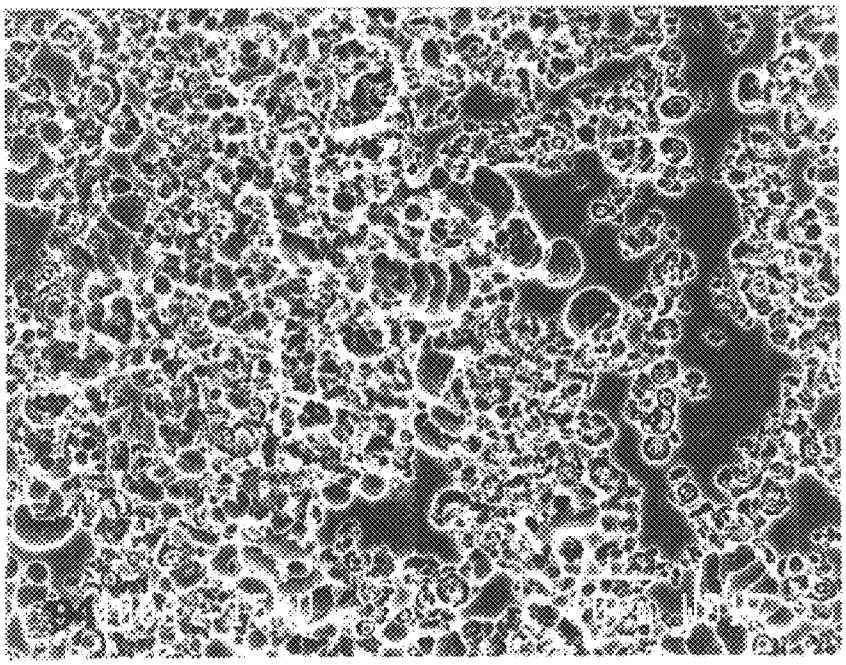
FIG. 2 (PRIOR ART)
Figure 3:
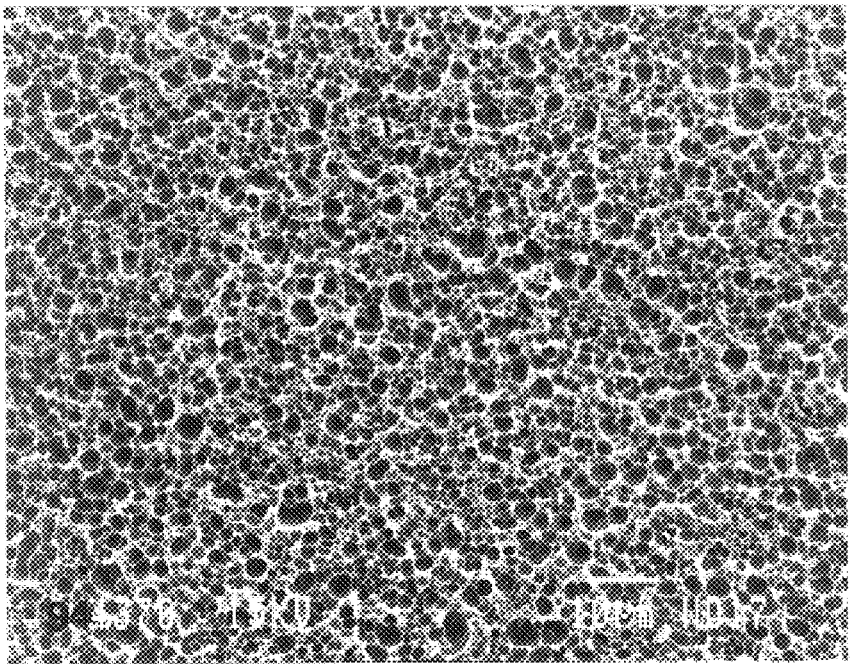

The etch patterns obtained in the same electrolyte and under the same conditions as in the first example exhibited, as a function of the applied charge, the behaviour documented in FIGS. 1 to 3 viz., FIG. 1: 450 coulombs/$dm^2$, conventionally produced lithographic sheet FIG. 2: 410 coulombs/$dm^2$, conventionally produced lithographic sheet FIG. 3: 380 coulombs/$dm^2$, lithographic sheet produced according to the invention.

What is claimed is:

1. Process for manufacturing a strip of aluminium or an aluminium alloy for electrolytically roughened lithographic printing plates, comprising:

(a) continuously casting the alloy as a cast strip in the gap between cooled rolls of a strip-casting machine to a thickness of at most 3 mm, the strip having very fine, intermetallic particles in high density and having a small grain size in the regions close to the surface of the cast strip, and, in order to prevent coarsening of grains, no further heat is applied to the strip which has been solidified in the roll gap; and (b) cold rolling the cast strip so that advantageous grain microstructure in the surface regions arising from rapid solidification is retained to final thickness with a thickness reduction of at least 90%, the cast strip not having any further heat applied to it until after the final thickness has been attained.

2. Process according to claim 1, characterized in that the cast strip is cold rolled to final thickness without intermediate annealing.

3. Process according to claim 1, characterized in that the thickness of the cast strip is about 2.5 to 2.8 mm.

4. Process according to claim 1 characterized in that, in order to prevent any coarsening of the grain structure, no further heat is applied to the strip which has been solidified in the roll gap and partially hot rolled has no further heat applied to it.

5. Process according to claim 1, characterized in that the thickness of the cast strip is at most about 2.5 to 2.8 mm.

6. Process according to claim 1, wherein the intermetallic particles in the regions close to the surface of the cast strip have an average spacing of less than 5 $\mu$m.

* * * * *